US011186926B2

(12) United States Patent
Tascan et al.

(10) Patent No.: US 11,186,926 B2
(45) Date of Patent: Nov. 30, 2021

(54) POLY(GLYCEROL SEBACATE) FIBERS, FABRICS FORMED THEREFROM, AND METHODS OF FIBER MANUFACTURE

(71) Applicant: THE SECANT GROUP, LLC, Telford, PA (US)

(72) Inventors: Mevlut Tascan, Perkasie, PA (US); Kayla Wroblesky, Schwenksville, PA (US); Todd Crumbling, Perkasie, PA (US); Michael S. Flemmens, Chicago, IL (US)

(73) Assignee: THE SECANT GROUP, LLC, Telford, PA (US)

( * ) Notice: Subject to any disclaimer, the term of this patent is extended or adjusted under 35 U.S.C. 154(b) by 382 days.

(21) Appl. No.: 16/178,140

(22) Filed: Nov. 1, 2018

(65) Prior Publication Data

US 2019/0127887 A1 May 2, 2019

Related U.S. Application Data

(60) Provisional application No. 62/580,749, filed on Nov. 2, 2017.

(51) Int. Cl.
*D01D 5/06* (2006.01)
*D01F 8/04* (2006.01)
(Continued)

(52) U.S. Cl.
CPC ..... *D01D 5/06* (2013.01); *D01D 5/40* (2013.01); *D01D 13/02* (2013.01); *D01F 6/62* (2013.01);
(Continued)

(58) Field of Classification Search
CPC .. A61F 2002/0068; A61F 2/0063; A61F 2/02; A61F 2210/0004; C12M 25/14;
(Continued)

(56) References Cited

U.S. PATENT DOCUMENTS

2015/0344618 A1 12/2015 Nicholson et al.
2016/0046832 A1 2/2016 Wroblesky et al.
(Continued)

FOREIGN PATENT DOCUMENTS

WO 2016205462 A1 12/2016
WO 2017147457 A2 8/2017

OTHER PUBLICATIONS

Rai, Ranjana, et al. Synthesis, properties and biomedical applications of poly(glycerol sebacate) (PGS): A review, Progress in Polymer Science, vol. 37, No. 8, Jan. 27, 2012, pp. 1051-1078.
(Continued)

*Primary Examiner* — Camie S Thompson
(74) *Attorney, Agent, or Firm* — McNees Wallace & Nurick LLC

(57) ABSTRACT

A manufacturing process includes spinning at least one continuous poly(glycerol sebacate) (PGS)/alginate fiber from a polymeric solution comprising PGS and alginate in water, drafting the at least one continuous PGS/alginate fiber in at least one coagulation bath, and drawing the at least one continuous PGS/alginate fiber from the at least one coagulation bath. A yarn includes at least one continuous PGS fiber. A continuous poly(glycerol sebacate) (PGS)/alginate fiber forming system includes a feeding tank holding a polymeric solution of alginate and PGS, a pump, a spinneret, a first coagulation bath, a first winder, a second coagulation bath, a second winder, and a bobbin winder, the system forming at least one continuous PGS/alginate fiber from the polymeric solution of alginate and PGS.

12 Claims, 3 Drawing Sheets

(51) Int. Cl.

| | |
|---|---|
| ***D01D 5/40*** | (2006.01) |
| ***D01D 13/02*** | (2006.01) |
| ***D01F 6/62*** | (2006.01) |
| ***D01F 6/92*** | (2006.01) |
| ***D01F 11/08*** | (2006.01) |
| ***D01F 8/14*** | (2006.01) |

(52) U.S. Cl.
CPC ..... *D01F 6/92* (2013.01); *D01F 8/04* (2013.01); *D01F 11/08* (2013.01); *D01F 8/14* (2013.01)

(58) Field of Classification Search
CPC ..... C12M 21/08; D01H 4/00; B29C 64/118; C08L 5/04; C08L 67/04; D10B 2331/00; D03D 15/00; D04B 1/14; D04B 21/12; C12N 2533/74; D06M 15/13; D01D 5/06; D01D 5/20; D01D 5/218; D01D 5/0076; D01D 10/06; D01D 1/02; D01D 1/06; D02G 3/00; D02G 3/04; D02G 3/02; D02G 3/448; Y10T 442/633; Y10T 442/696; Y10T 442/2913; Y10T 442/2967; Y10T 428/24994; D01F 9/04; D01F 6/94; D01F 8/04; D01F 11/08; D01F 6/62; D01F 6/92; D01F 8/14; C08G 63/66; A61K 47/34
USPC ..... 606/151, 49; 264/180, 210.8; 425/66, 425/71; 28/140; 139/420 R, 426 R; 428/373, 292.1; 523/113; 156/229
See application file for complete search history.

(56) References Cited

U.S. PATENT DOCUMENTS

2016/0143720 A1* 5/2016 Matheny ..... A61F 2/02 606/151
2016/0251540 A1 9/2016 Nicholson et al.

OTHER PUBLICATIONS

Salehi, Sahar, et al. General of PGS/PCL Blend Nanofibrous Scaffolds Mimicking Corneal Stroma Structure, Macromolecular Materials and Engineering, vol. 299, No. 4, Jul. 19, 2013, pp. 455-469.
Xu, Bing, et al. Aligned core/shell electrospinning of poly(glycerol sebacate)/poly(L-lactic acid) with tuneable structural and mechanical properties, Polymer International, vol. 65, No. 4, Feb. 12, 2016, pp. 423-429.

* cited by examiner

POLY(GLYCEROL SEBACATE) FIBERS, FABRICS FORMED THEREFROM, AND METHODS OF FIBER MANUFACTURE

CROSS-REFERENCE TO RELATED APPLICATIONS

This application claims priority to and the benefit of U.S. Provisional Application No. 62/580,749 filed Nov. 2, 2017, which is hereby incorporated by reference in its entirety.

FIELD OF THE INVENTION

This application is directed to fibers containing poly (glycerol sebacate) (PGS), fabrics formed from such fibers, and systems and methods of fiber manufacture. More particularly, the present application is directed to continuous PGS fibers; PGS/alginate fibers; woven, knitted, braided, and non-woven fabrics containing such fibers; and systems and methods of manufacturing continuous PGS fibers.

BACKGROUND OF THE INVENTION

Poly(glycerol sebacate) (PGS) is a cross-linkable elastomer formed as a co-polymer from glycerol and sebacic acid. PGS is biocompatible and biodegradable, reduces inflammation, improves healing, and has antimicrobial properties, all of which make it useful as a biomaterial in the biomedical field.

Although PGS has previously been formed into fibers for electrospinning, such fibers are deposited to create a mat, and they cannot be readily woven, knitted, or braided. The three-dimensional chemistry, tack, and thermal properties of PGS resin have prevented its manufacture as a continuous fiber.

Alginate is a polysaccharide that may be derived from brown algae. Alginate is commonly used in the field of wound care as a biocompatible, highly-absorptive material.

BRIEF DESCRIPTION OF THE INVENTION

Exemplary embodiments are directed to processes of manufacturing continuous PGS/alginate fibers, processes of manufacturing fabrics including continuous poly(glycerol sebacate) (PGS)/alginate fibers, yarns including continuous PGS/alginate fibers, fabrics including continuous PGS/alginate fibers, and fabrics including continuous PGS fibers.

According to an exemplary embodiment, a manufacturing process includes spinning at least one continuous PGS/alginate fiber from a polymeric solution comprising PGS and alginate in water, drafting the at least one continuous PGS/alginate fiber in at least one coagulation bath, and drawing the at least one continuous PGS/alginate fiber from the at least one coagulation bath.

According to another exemplary embodiment, a yarn includes a continuous PGS/alginate fiber.

According to another exemplary embodiment, a continuous PGS/alginate fiber forming system includes a feeding tank holding a polymeric solution of alginate and PGS, a pump receiving the polymeric solution of alginate and PGS from the feeding tank and pumping the aqueous solution of alginate and PGS, a spinneret receiving the aqueous solution of alginate and PGS from the pump and forming from the PGS and alginate and extruding at least one continuous PGS/alginate fiber, a first coagulation bath holding a first solution comprising a salt in water and receiving the at least one continuous PGS/alginate fiber from the spinneret, a first winder receiving the at least one continuous PGS/alginate fiber from the first coagulation bath, a second coagulation bath holding a second solution comprising distilled water and receiving the at least one continuous PGS/alginate fiber from the first winder, a second winder receiving the at least one continuous PGS/alginate fiber from the second coagulation bath, and a bobbin winder winding the at least one continuous PGS/alginate fiber from the second winder onto at least one bobbin.

Among the advantages of exemplary embodiments is that the fiber or fabric may be used in a medical application.

Another advantage is that the fiber or fabric is biodegradable.

Still another advantage is that the fiber or fabric has elastomeric properties.

A further advantage is that the fiber or fabric has antimicrobial properties.

Other features and advantages of the present invention will be apparent from the following more detailed description of exemplary embodiments that illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF EXEMPLARY EMBODIMENTS

Exemplary embodiments are directed to systems and processes of manufacturing continuous poly(glycerol sebacate) (PGS)/alginate fibers and yarns and fabrics including continuous PGS/alginate fibers, manufactured yarns and fabrics including continuous PGS/alginate fibers, and manufactured fabrics including continuous PGS fibers. Embodiments of the present disclosure, in comparison to fabrics and manufacturing processes not using one or more of the features disclosed herein, provide PGS in a continuous fiber that is weavable, knittable, and braidable, provide a biodegradable yarn with antimicrobial properties, provide a biodegradable fabric with antimicrobial properties, provide a yarn including PGS, provide a fabric including PGS, or combinations thereof.

Provided herein are continuous PGS/alginate fibers, systems and processes of manufacturing, and methods of use. Although discussed primarily with respect to a multifilament yarn, as will be appreciated by those skilled in the art, the continuous PGS fiber may alternatively be formed and used as a monofilament or a sheath core design.

A continuous fiber of PGS is formed by a combination of PGS and alginate. The continuous fiber may be further processed for textile manufacture. This combination of PGS and alginate may take one or more of multiple forms, which may include, but are not limited to, a mechanical dispersion of PGS in a sea of alginate, a sheath core of alginate surrounding a PGS core, and a PGS that is chemically modified to better mix with alginate, in the creation of a continuous PGS fiber. The chemically-modified PGS may be a PGS salt. In some embodiments, the PGS is provided as part of a copolymer.

Unexpectedly, the continuous PGS fiber is tack-free in the uncured state when formed in combination with alginate, unlike uncured PGS resin in the absence of alginate. This allows the continuous PGS fiber to be taken up on a bobbin, backwound, and then formed into a textile structure. In some embodiments, such as, for example, with a sheath-core design, the continuous PGS/alginate fiber includes a continuous PGS fiber extending the entire length or substantially the entire length of the PGS/alginate fiber. Once a structure is formed from the continuous PGS fiber, it may be set through a curing process. Appropriate curing processes may include, but are not limited to, convection curing, infrared (IR) curing, microwave curing, or combinations thereof. Depending on the type of fiber, once the PGS is fully cured in the structure, the alginate may be washed away as a sacrificial material, thereby creating a 100% or substantially 100% PGS fiber.

Figure 1:
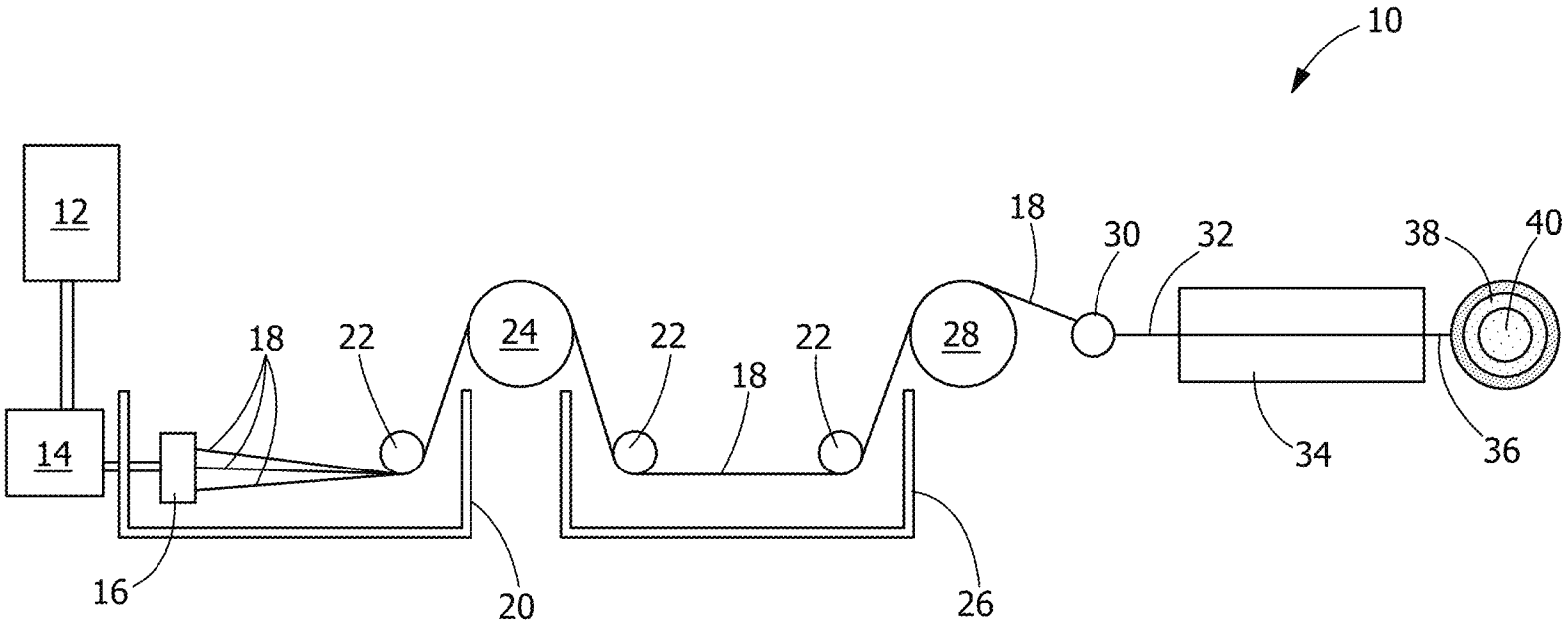
FIG. 1 schematically shows a continuous PGS/alginate fiber formation system and manufacturing process in an embodiment of the present disclosure.

Referring to FIG. 1, a continuous PGS fiber formation system 10 converts an aqueous solution of alginate and PGS into a yarn 36. The aqueous solution of alginate and PGS is transferred from a feeding tank 12 by a pump 14 into a spinneret 16, which produces and extrudes PGS/alginate multifilament fibers 18 into a first coagulation bath 20. The PGS/alginate multifilament fibers 18 are then drawn on a draw roll 22 through the first coagulation bath 20 and out of the first coagulation bath 20 by a first winder 24 and into a second coagulation bath 26. Additional draw rolls 22 direct the PGS/alginate multifilament fibers 18 through the second coagulation bath 26. The PGS/alginate multifilament fibers 18 are then fed by a second winder 28 into an intermingler 30 to produce a yarn round 32. Excess water is taken out of the yarn round 32 by a dryer 34 to provide the yarn 36, which is traversed onto a bobbin 38 by a bobbin winder 40.

Figure 2:
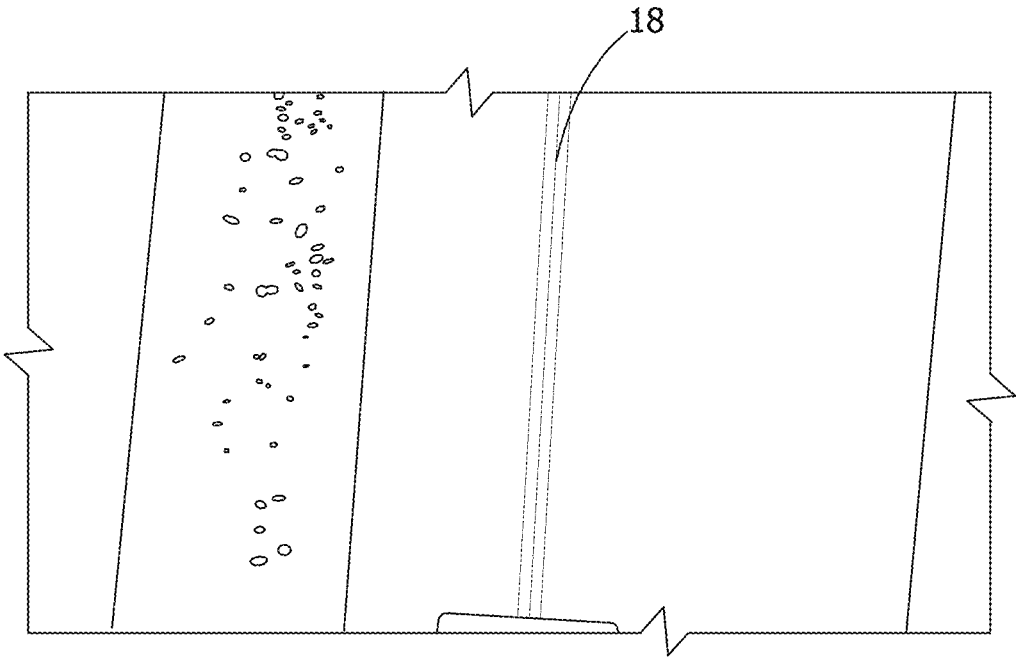
FIG. 2 is an image of a continuous PGS/alginate fiber being extruded into a coagulation bath in an embodiment of the present disclosure.

FIG. 2 is an image of a PGS/alginate multifilament fiber 18 as it is being extruded into a first coagulation bath 20.

Figure 3:
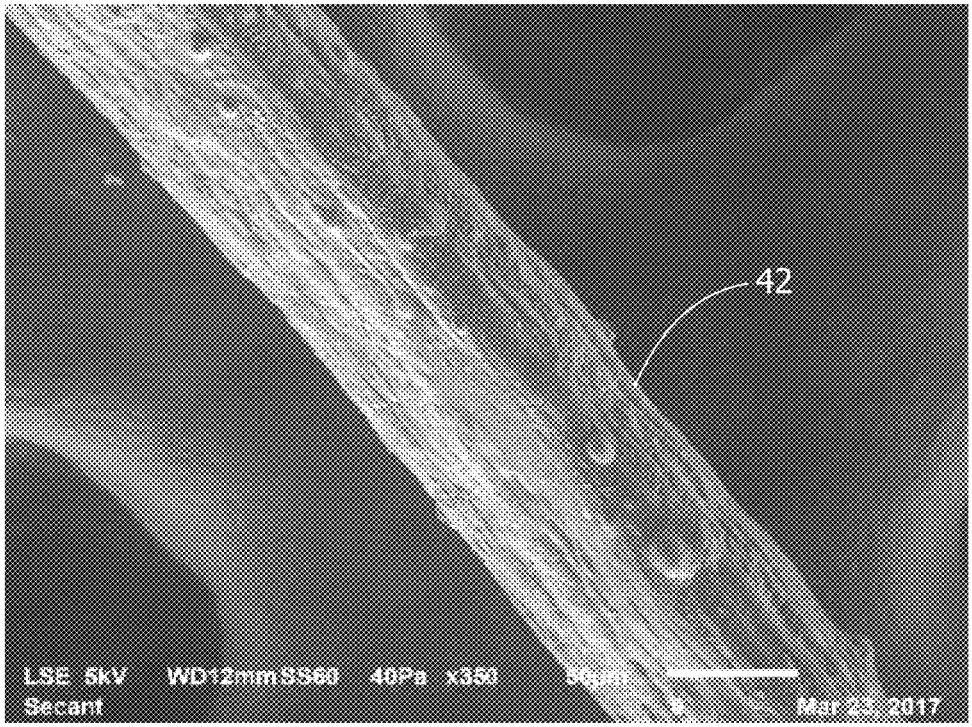
FIG. 3 is an image of a portion of a monofilament continuous PGS/alginate fiber in an embodiment of the present disclosure.

FIG. 3 is an image of a monofilament continuous PGS/alginate fiber 42 in an uncured state. The monofilament continuous PGS/alginate fiber 42 has a diameter of about 100 μm.

Figure 4:
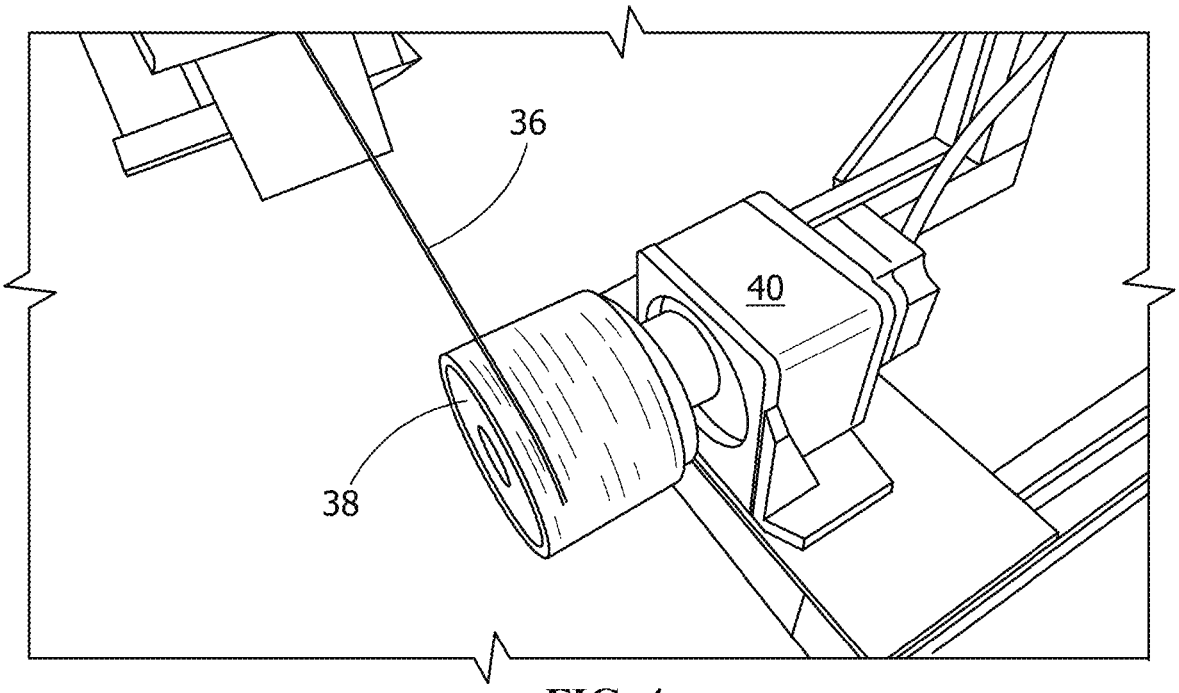
FIG. 4 is an image of a continuous PGS/alginate fiber traversed onto a bobbin winder in an embodiment of the present disclosure.

FIG. 4 is an image of a yarn 36 being wound onto a bobbin 38 by a bobbin winder 40.

Figure 5:
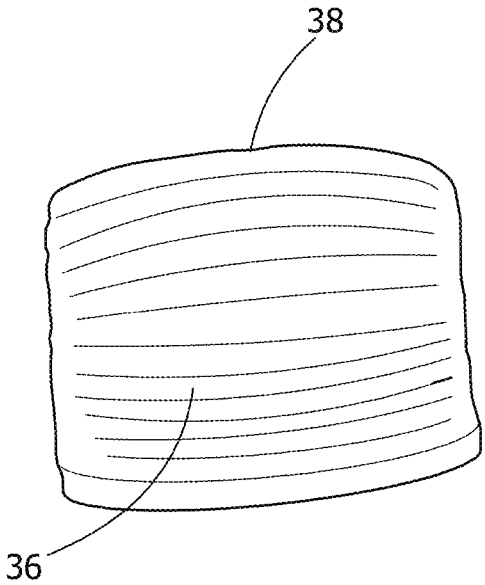
FIG. 5 is an image of a bobbin of a continuous PGS/alginate fiber in an embodiment of the present disclosure.

FIG. 5 is an image of a yarn 36 wound on a bobbin 38.

In some embodiments, a mixture for the feeding tank 12 is prepared by first preparing a solution of alginate in distilled water with mixing and heating, preferably to a temperature of about 70° C. (158° F.) or greater, more preferably to a temperature of about 80° C. (176° F.) or greater. The alginate in the solution is, by weight, at about 3% to about 10%, alternatively about 3% to about 7%, alternatively about 3% to about 5%, alternatively about 5% to about 7%, alternatively about 4% to about 5%, alternatively about 5% to about 6%, alternatively about 3%, alternatively about 4%, alternatively about 5%, alternatively about 6%, alternatively about 7%, or any value, range, or sub-range therebetween. In an exemplary embodiment, the alginate is selected to have a viscosity in the range of 2 centipoise to 10 centipoise at a 1% by weight solution at 80° C. Molten PGS is then added to the solution to achieve a PGS/dry alginate weight ratio of about 1:1 or greater, alternatively about 1:1, alternatively about 1:1 to about 3:1, alternatively about 1:1 to about 2:1, alternatively about 2:1, alternatively about 2:1 to about 3:1, alternatively about 3:1, or any value, range, or sub-range therebetween. In an exemplary embodiment, the PGS is selected to have a viscosity in the range of 3000 centipoise to 4000 centipoise at 80° C.

To create a multifilament yarn round 32, a standard wet spin line may be utilized with a multi-hole spinneret 16, one or more coagulation baths 20, 26, draw rolls 22, an intermingler 30, a bobbin winder 40, and a traverse (not shown). In at least one case, the multifilament yarn round 32 leaving the intermingler 30 was observed to have a moisture content of about 65% by weight. Optionally, one or more dryers 34 are used in line to remove at least some residual water from the yarn round 32, if desired, such as to achieve a yarn 36 with a predetermined moisture content. A glycerol-based spin finish is optionally applied to the wet or partially-dried fibers of the yarn 36 to prevent water evaporation or optionally applied to the partially-dried, substantially-dried, or dried fibers of the yarn 36 to lubricate and reduce the brittleness of the fibers. In some embodiments, the intermingler 30 prevents fibers of the multifilament yarn round 32 from flattening during formation of the multifilament yarn round 32.

Appropriate spinnerets 16 for the continuous PGS fiber formation system 10 may include, but are not limited to, a multifilament design, a monofilament design, or a sheath core design, depending on the desired form of the PGS/alginate fiber. In some embodiments, the multifilament spinneret 16 includes about 40 holes, each hole having a diameter of about 125 μm.

Appropriate compositions for the coagulation baths 20, 26 may include, but are not limited to, aqueous solutions of 1-20% by weight of a salt in water or distilled water. In some embodiments, the salt is a salt of a divalent cation. In some embodiments, the divalent cation is calcium. In some embodiments, the salt is calcium chloride ($CaCl_2$). In some embodiments, distilled water is used in a final coagulation bath prior to the intermingler 30 to wash the fibers.

The second coagulation bath 26 preferably has a lower concentration of the salt than the first coagulation bath 20. In some embodiments, the continuous PGS fiber formation system 10 includes a third coagulation bath with a lower concentration of the salt than the second coagulation bath 26. In some embodiments, the concentration of the salt in the final coagulation bath is less than 1% by weight. The final coagulation bath may start as distilled water with no salt to wash the salt from the PGS/alginate fibers. The PGS/alginate multifilament fibers 18 may also or alternatively be washed with distilled water by an additional process after the spinning.

Although the continuous PGS fiber formation system 10 and process in FIG. 1 are described as using a multi-hole spinneret 16 in a wet spinning line, PGS/alginate fiber may alternatively be produced using a monofilament core/sheath hole and then intermingling the PGS/alginate fibers together to produce a yarn 36. The spinning may be performed at or near room temperature or ambient temperature, such as, for example, in the range of about 15° C. to about 25° C. (about 59° F. to about 77° F.) In some embodiments, the spinning is performed at an elevated temperature slightly above room temperature or ambient temperature, such as, for example in the range of about 25° C. to about 35° C. (about 77° F. to about 95° F.).

In some embodiments, the first coagulation bath 20 is a solution of a salt in distilled water. The first coagulation bath 20 may be at or near room temperature or ambient temperature, such as, for example, in the range of about 15° C. to about 25° C. (about 59° F. to about 77° F.). In some embodiments, the first coagulation bath 20 is at an elevated temperature slightly above room temperature or ambient temperature, such as, for example in the range of about 25° C. to about 45° C. (about 77° F. to about 113° F.). In some embodiments, the first coagulation bath 20 includes about 10% or more of a salt by weight. Heating the first coagulation bath 20 to increase its temperature permits the drafting process to be done at a lower concentration of a salt, but the concentration of the salt is preferably not less than 2% by weight for the first coagulation bath 20 even at elevated temperatures. Heating the first coagulation bath 20 may also permit drafting that produces a stronger multifilament yarn round 32 of PGS/alginate fiber. After drafting, the yarn may pass through an intermingler 30 and then a dryer 34. The dryer 34 may be a through-air dryer or an infrared dryer.

In an exemplary manufacturing process to form a yarn 36, a 6% by weight sodium alginate solution in distilled water is prepared, and then molten PGS is added to match the dry weight of alginate. For example, 100 g of a 6% alginate may be combined with 6 g of molten PGS. The combination is then mixed. A dual asymmetric high shear mixer may be used to create a dispersion of the PGS within the alginate. The mixture is then fed by a pump 14, such as, for example, a 0.3 cc/rev gear pump, through a spinneret 16, such as, for example, a 10-hole, 100-μm spinneret 16, into a first coagulation bath 20 of a first coagulation solution, such as an aqueous 10% by weight salt solution, and the formed PGS/alginate multifilament fibers 18 are drawn on draw rolls 22, such as, for example, at a rate of about 20 m/min. The formed PGS/alginate multifilament fibers 18 are drawn out of the first coagulation bath 20 and into a second coagulation bath 26 of a second coagulation solution, such as an aqueous 5% by weight salt solution. The PGS/alginate multifilament fibers 18 may optionally be further drawn out of the second coagulation bath 26 and into a third coagulation bath (not shown) containing no more than 1% salt by weight. The PGS/alginate multifilament fibers 18 are then fed into the intermingler 30 to produce the multifilament yarn round 32. Excess water may be taken out by one or more dryers 34, and the PGS/alginate multifilament yarn 36 is wound onto the bobbin 38, such as, for example, at a high traverse angle. A high traverse angle may be any angle of about 6 degrees or greater, such as, for example, about 6-18 degrees, alternatively about 9-15 degrees, alternatively about 11-13 degrees, alternatively about 12 degrees, or any value, range, or sub-range therebetween.

After the produced multifilament yarn round 32 is appropriately dried, it may be woven, knitted, or braided into a fabric. The forming into a fabric may be performed using traditional fabric-forming processes. Additional backwinding and twisting may be done prior to fabric forming, if needed. If the yarn strength is not great enough for a specific application, such as, for example, weaving, sizing may be used for the warp yarn and/or high twist may be applied to the warp yarn. In some embodiments, the tension during the fabric-forming process is minimized relative to the tensile properties of the yarn 36. In some embodiments, a high-denier yarn is used for weaving, and a lower-denier yarn is used for knitting and braiding, since less tension is applied during knitting and braiding processes than during weaving processes.

Once a fabric is produced from PGS/alginate fibers, the fabric may be processed to cure the PGS polymer in the fabric. Subsequently, depending on the type of yarn 36, some, all, or substantially all of the alginate may be removed from the fabric by high temperature washing with water after curing, thereby producing a fabric that may be at least 99%, alternatively at least 99.5%, alternatively about 100% PGS by weight. When the alginate is to be removed, a PGS/alginate core/sheath fiber design is preferably used so that the structural integrity of the resulting fabric, especially the tensile properties, is not affected by the removal of the alginate. Upon curing, the PGS is crosslinked, and removal of the alginate part of the PGS/alginate fibers may result in a physiologically-stable, 100% PGS fiber fabric.

As PGS is also biocompatible and biodegradable, PGS/alginate fibers, yarn, and fabrics may be used at least for any application that an alginate fiber by itself is used. The PGS, however, adds an antimicrobial property to the fiber product that alginate lacks. It is expected that this is the first type of fabric that may be used in any application having such an antimicrobial effect and biodegradability.

A PGS/alginate fabric is completely biodegradable and also has antimicrobial properties by way of the nature of the PGS. Therefore, a PGS/alginate fabric may be used in the medical sector and such a fabric may be part of any type of device used in the human body. In some embodiments, the PGS/alginate fiber is used in textile processing for medical applications. In some embodiments, the PGS/alginate fiber is used in an implantable device or a topical device, such as, for example, for a wound care application.

In addition to the advantages of the fabric structure, the PGS/alginate fiber provides an antimicrobial effect to any biodegradable medical device. A PGS/alginate fabric may be produced having a desired porosity and strength for suture retention.

In some embodiments, PGS-alginate mixtures are used to create thin films for medical applications.

In some embodiments, a PGS/alginate yarn round 32 is used to produce fabrics with woven, knitted, or braided structures, which may be used in or on the human body for any purpose. In some embodiments, the fabrics are used for wound care. Although alginates are already used in wound care, the addition of PGS provides new antimicrobial properties to inhibit or prevent infection at the wound site.

After being woven, knitted, or braided, the produced fabric of PGS/alginate fibers may be cured in an oven. In some embodiments, the produced fabric is placed in the oven at about 120° C. (about 230° F.) for about 24 hours to cure the PGS in the fabric. The alginate may be washed away by washing the cured fabric with distilled water at about 80° C. (about 176° F.) for about 10 minutes. After the alginate is washed away, the fabric is purely or substantially purely PGS. Such a procedure may be done on any structure made from mixed PGS/alginate multifilament yarn or PGS/alginate sheath-core fibers. After the structure is produced, it may be used in or on the body in any useful application where biocompatibility, biodegradability, and antimicrobial properties are needed or desirable.

The continuous PGS fibers described herein expand the manufacturing use of raw PGS material to include textile structures, which may include, but are not limited to, woven, knitted, braided, or nonwoven textile structures. Since PGS is an elastomer, the mechanical properties of PGS may be translated to a fiber, thereby creating elastomeric fibrous structures. Biologically, the incorporation of PGS into a fiber, whether neat or in combination with other materials, may provide antimicrobial benefits, inflammation reduction, and/or improved healing. From a drug delivery perspective, the incorporation of PGS into a fiber, either neat or in combination with other materials, may provide a controlled release fiber material for use in a multitude of applications.

As mentioned previously, alginate is a highly absorptive material. A PGS fiber in combination with alginate may provide controlled active release properties. A PGS/alginate multifilament or monofilament yarn is capable of absorbing fluids in applications, such as wound care, while additionally providing the antimicrobial and biological benefits of PGS. Prior to use of a component including a PGS/alginate yarn, the alginate may be loaded with an active ingredient, which is then released slowly in a controlled manner when a structure including the PGS/alginate fibers is placed in or on the body.

While the foregoing specification illustrates and describes exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A manufacturing process comprising:

spinning at least one continuous poly(glycerol sebacate) (PGS)/alginate fiber from a polymeric solution comprising PGS and alginate in water;

drafting the at least one continuous PGS/alginate fiber in at least one coagulation bath; and drawing the at least one continuous PGS/alginate fiber from the at least one coagulation bath.

2. The manufacturing process of claim 1, wherein the at least one continuous PGS/alginate fiber comprises a plurality of continuous PGS/alginate fibers.

3. The manufacturing process of claim 2 further comprising intermingling the plurality of continuous PGS/alginate fibers to form a multifilament yarn round.

4. The manufacturing process of claim 1 further comprising drying the at least one continuous PGS/alginate fiber to form a yarn having a predetermined moisture content.

5. The manufacturing process of claim 1 further comprising winding the at least one continuous PGS/alginate fiber on a bobbin at a traverse angle of about 6 degrees or greater.

6. The manufacturing process of claim 1 further comprising combining molten PGS and an alginate solution of alginate in water to form the polymeric solution.

7. The manufacturing process of claim 6, wherein the alginate solution comprises alginate in water at 3% to 10% by weight of the alginate solution, the molten PGS being combined at a ratio of 1:1 to 3:1 by weight with respect to the alginate.

8. The manufacturing process of claim 1, wherein the at least one coagulation bath comprises a first coagulation bath containing a first coagulation solution comprising at least 2% by weight calcium chloride in water.

9. The manufacturing process of claim 8, wherein the at least one coagulation bath further comprises a second coagulation bath containing a second coagulation solution comprising 1% or less by weight calcium chloride in distilled water.

10. The manufacturing process of claim 1 further comprising forming a fabric from the at least one continuous poly(glycerol sebacate) (PGS)/alginate fiber.

11. The manufacturing process of claim 10, wherein the forming is selected from the group consisting of weaving, knitting, and braiding.

12. The manufacturing process of claim 10 further comprising curing the PGS of the at least one continuous poly(glycerol sebacate) (PGS)/alginate fiber after forming the fabric.

* * * * *